US006081176A

United States Patent [19]

Dittmann et al.

[11] Patent Number: 6,081,176

[45] Date of Patent: Jun. 27, 2000

[54] ELECTROMAGNETIC RELAY

[75] Inventors: Michael Dittmann; Jens Heinrich, both of Berlin; Rainer Vogel, Teltow; Titus Ziegler, Berlin, all of Germany

[73] Assignee: Siemens Electromechanical Components GmbH & Co. KG, Munich, Germany

[21] Appl. No.: 09/363,266

[22] Filed: Jul. 29, 1999

[30] Foreign Application Priority Data

Jul. 29, 1998 [DE] Germany ..... 198 34 215

[51] Int. Cl.[7] ..... H01H 67/02

[52] U.S. Cl. ..... 335/128; 335/83

[58] Field of Search ..... 335/78–86, 124, 335/128, 4, 5

[56] References Cited

U.S. PATENT DOCUMENTS 4,978,935 12/1990 Hoffman et al. ..... 335/121
5,207,318 5/1993 Ronald et al. ..... 200/534

FOREIGN PATENT DOCUMENTS 39 35 351 A1 4/1991 Germany .

OTHER PUBLICATIONS

Schaltbau–Gesellschaft m.b.H., München, Kontaktanordnung, insbesondere für elektromagnetische Relais, 9.4.60, Sch 27 065 (T.3;Z.1), pp. 1–4, (no date).

*Primary Examiner*—Lincoln Donovan
*Attorney, Agent, or Firm*—Hill & Simpson

[57] ABSTRACT

An electromagnetic relay has a magnet system, a base, a movable contact element, stationary contact elements and contact terminal elements. The base is formed by a printed circuit board arrangement. A first printed circuit board of the printed circuit board arrangement thereby faces toward the magnet system, and a second printed circuit board of the printed circuit board arrangement forms a bottom side of the relay. Each of the two printed circuit boards has interconnects. The movable contact element is actuated by an armature and is arranged between the two printed circuit boards. An actuation element that transmits the movement of the armature onto the movable contact element has a pin-shaped end section projecting through a recess in the first printed circuit board. The contact terminal elements are pin-shaped and project through congruent recesses in the two printed circuit boards.

10 Claims, 3 Drawing Sheets

ELECTROMAGNETIC RELAY

BACKGROUND OF THE INVENTION

1. Field of the Invention

The present invention relates to an electromagnetic relay device having a magnet system, winding terminal elements, a base, a movable contact element, an actuation element, stationary contact elements and contact terminal elements.

2. Description of the Prior Art

In conventional relays, the design of the base assembly causes high tooling costs and also offers only slight flexibility, particularly in view of the terminal grid and the dimensions. The fixed contacts are usually welded onto punched bands that are extrusion-coated with thermal plastic synthetic. The relay terminals are shaped from these punched bands by bending and cutting. Conventional thermal plastic synthetics offer inadequate thermal stability with respect to the temperatures that occur during reflow soldering. In order to improve the thermal loadability, plastics—usually LCP—that are highly heat-resistant and extremely expensive are often employed.

SUMMARY OF THE INVENTION

It is an object of the present invention to create a relay whose base assembly can be manufactured with little tooling outlay and that is distinguished by high flexibility in view of the terminal grid and dimensions. It is a further object that the base assembly exhibit adequate thermal stability with respect to the high temperatures, particularly those occurring during reflow soldering.

The above object is achieved by an electromagnetic relay having a magnet system composed of an excitation coil, a core and an armature, coil terminal elements, a base formed by a printed circuit board arrangement, whereby a first printed circuit board of the printed circuit board arrangement faced toward the magnet system and a second printed circuit board of the printed circuit board arrangement forms a bottom side of the relay, and each of the two printed circuit boards comprises interconnects, at least one movable contact element actuated by the armature that is arranged between the two printed circuit boards, an actuation element that transmits the movement of the armature onto the movable contact element and that has a pin-shaped end section that projects through a recess in the first printed circuit board and is connected to the movable contact element, stationary contact elements that are arranged at a section of a printed circuit board facing toward the movable contact element, and pin-shaped contact terminal elements that project through congruent recesses in the two printed circuit boards and are connected via the interconnects to the allocated, stationary contact elements, whereby the contacting between the contact terminal elements and the respective interconnects ensues in the region of the recesses.

Such a design of the base assembly makes it possible to avoid special tools for punching and extrusion-coating. Furthermore, a plurality of magnet systems can be arranged on a common printed circuit board, whereby at least one movable contact element is allocated to each magnet system. The interconnection of the relay can be realized directly by the interconnects on a printed circuit board. Moreover, it is possible to likewise arrange any components, if present, that are usually externally interconnected to the relay on the common circuit board as well and to interconnect these with the relay via the interconnects of the printed circuit board. Complete modules can thus be formed that, for example, can also be equipped with an integrated plug-type connector for the realization of an interface.

The stationary contact elements are preferably applied both on the first printed circuit board as well as on the second printed circuit board, resulting in the relay having change-over contacts. In a first of two possible working positions, the movable contact element, lying directly against the first printed circuit board, produces the connection between the stationary contact elements applied onto the first printed circuit board. Correspondingly, in a second position of the actuation element, only the stationary contact elements that are applied on the second printed circuit board are connected to one another. A pin-shaped contact terminal element can be connected via corresponding interconnects both to a stationary element on the first printed circuit board as well as to a stationary contact element on the second printed circuit board, resulting in a center contact terminal element.

In order to assure an adequate thermal stability, the two printed circuit boards are composed of a duro-plastic synthetic. In a further development, the pin-shaped contact terminal elements are respectively positively surrounded by an annular spacer element in a section between the two printed circuit boards. The outside diameter of this spacer element is larger than the diameter of the recess through which the pin-shaped contact terminal elements are plugged. As a result, the distance between the two printed circuit boards is kept constant and, further, the mechanical stability of the base assembly is enhanced. The spacer elements can also be applied on one piece to the pin-shaped contact terminal elements.

At their free ends, the pin-shaped contact terminal elements can be fashioned to form press-in stems. Alternatively, it is possible that the second printed circuit board is through-contacted, and that the contact terminal elements are formed by solder bowls arranged at the underside of the second printed circuit board. A number of possibilities are available for designing the stationary contact elements. The stationary contact elements can, for example, be fashioned as solid contacts, contact rivets, and/or having bond pads applied onto the interconnects.

DESCRIPTION OF THE PREFERRED EMBODIMENTS

Figure 1:
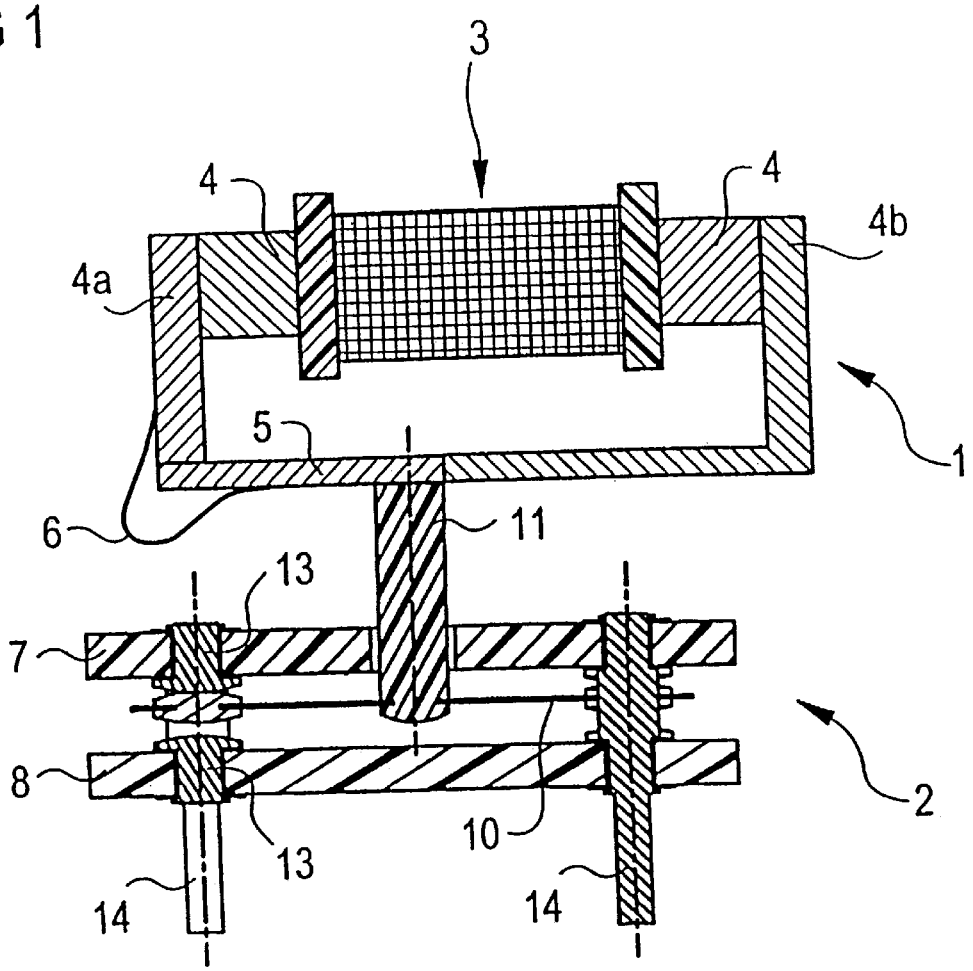
FIG. 1 is a schematic longitudinal section through an inventive relay showing a magnetic system and a base assembly.

The relay shown in FIG. 1 includes a magnet system 1 that is composed of an excitation coil 3, a core 4 arranged axially in the excitation coil 3 and two pole shoes 4*a* and 4*b* adjoining at the ends of the core 4, and is also composed of a cutout blade 5. The armature 5 has a first end seated at the free end of a first pole shoe 4*a*, whereas a working air gap is formed between the second end of the armature 5 and the free end of the second pole shoe 4*b*. The first pole shoe 4*a* is essentially rod-shaped, whereas the second pole shoe 4*b* is L-shaped. When the excitation disappears, the armature 5 is deflected into a quiescent position via a restoring spring 6. A solenoid plunger magnet system or a lifter armature magnet system might also be used for the magnet system shown in FIG. 1.

Figure 2:
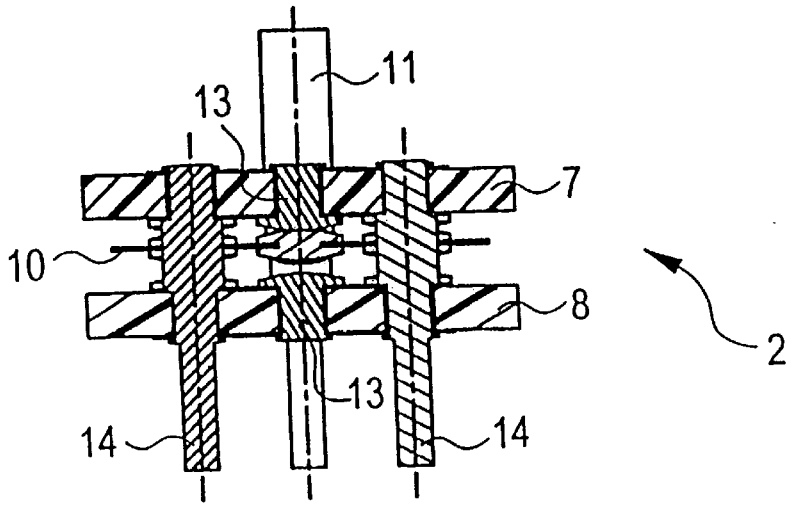
FIG. 2 is a cross-section of the base assembly in FIG. 1.

Further, the inventive relay of FIG. 1 has a base 2 that is formed by a printed circuit board arrangement having two printed circuit boards 7 and 8. A first printed circuit board 7 faces toward the magnet system 1, whereas the second printed circuit board 8 forms a bottom side of the relay from which pin-shaped contact terminal elements 14 emerge (also see FIG. 2). A movable contact element 10 is arranged between the two printed circuit boards 7 and 8. The movement of the armature 5 is transmitted onto the movable contact element 10 via an actuation element 11 having a pin-shaped end section that projects through a recess 12 of the first printed circuit board 7 (also see FIG. 3).

Figure 3:
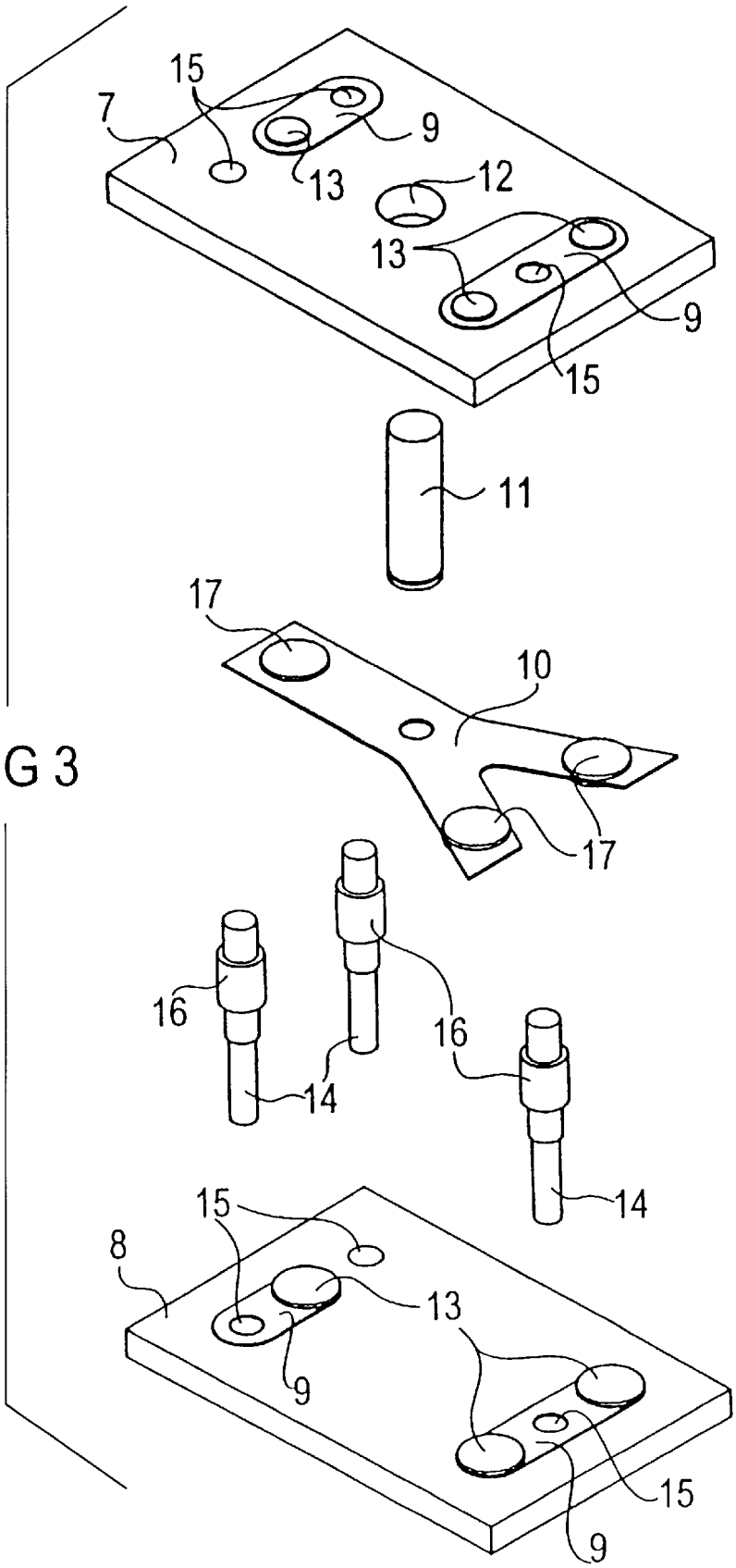
FIG. 3 is an isometric exploded view of the base assembly in FIG. 2.
Figure 4:
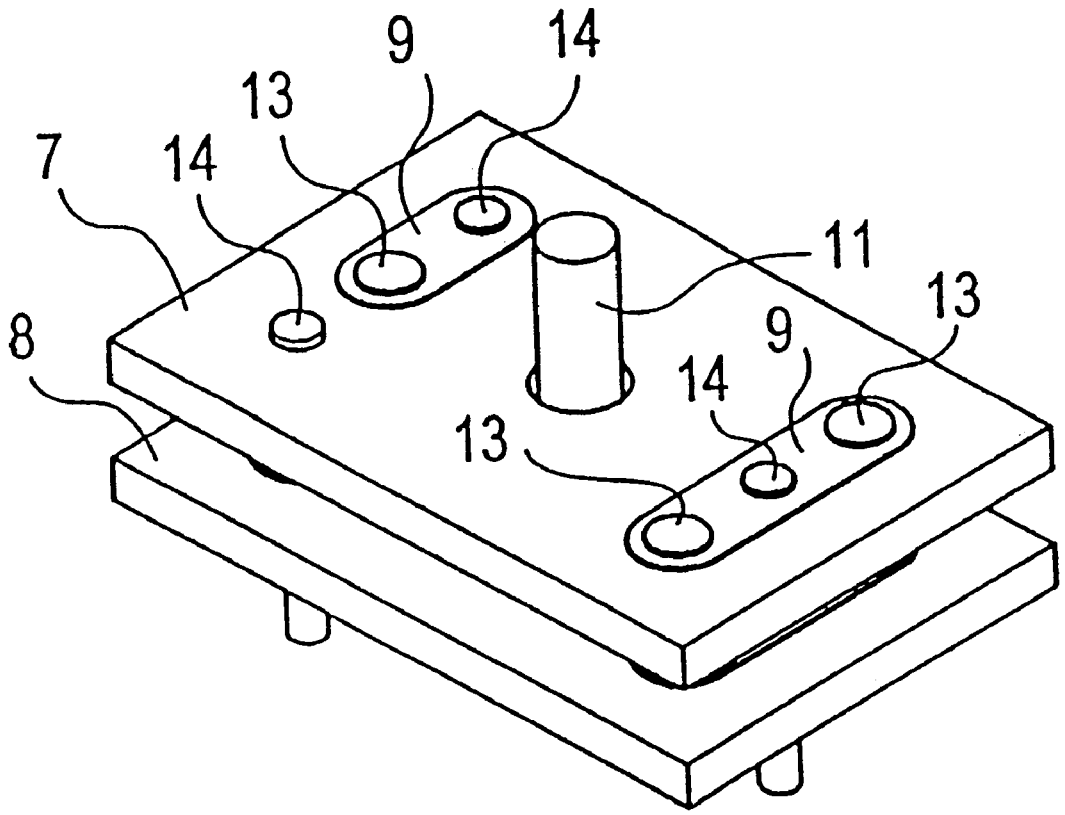
FIG. 4 is an isometric view of the assembled base assembly in FIG. 2.

With reference to FIG. 3, interconnects 9 can be seen that are applied both onto the first printed circuit board 7 as well as onto the second printed circuit board 8. The interconnects 9 produce the electrical connection between the stationary contact elements 13 applied on the printed circuit boards 7 and 8 and the pin-shaped contact terminal elements 14. The pin-shaped contact terminal elements 14 are conducted through specific recesses 15 that are congruently arranged at both printed circuit boards 7 and 8. In the present example, three pin-shaped contact terminal elements 14 are employed for realizing a relay having a change-over contact. The contact between the pin-shaped contact terminal elements 14, which have their free ends fashioned to form press-in stems, and the interconnects 9 occurs in the region of the recesses 15 for the contact terminal elements 14. The contact terminal elements 14 also have specific spacer elements 16 with which the cross-section of the pin-shaped contact terminal elements 14 is broadened step-like in the region between the two printed circuit boards 7 and 8, allowing the two printed circuit boards 7 and 8 to be positioned at a fixed spacing from one another. Further, the stationary contact elements 13 arranged on both printed circuit boards 7 and 8 are realized by contact rivets. In a corresponding way, rivet dimples 17 that work in conjunction with the stationary contact elements 13 are applied on the movable contact element 10.

The movable contact element 10 has two working positions, as does the armature 5. In a first working position, the contact rivets 17 of the movable contact element 10 lie directly against the stationary contact elements 13 of the first printed circuit board 7, whereas in a second working position, they lie against the stationary contact elements 13 of the second printed circuit board 8 and electrically connect these to one another. The pin-shaped contact terminal elements 14 are arranged in a triangular matrix to match the Y-shape of the movable contact element 10. In the region of a first end face of the printed circuit board arrangement, two contact terminal elements 14 flank a leg of the movable contact element 10, whereas a third contact terminal element 14 in the region of a second end face of the printed circuit board arrangement is surrounded by two legs of the movable contact element 10. The pin-shaped contact terminal element 14 surrounded by the legs of the contact element 10 is connected respectively to two stationary contact terminal elements 13 via interconnects 9 both on the first printed circuit board 7 as well as on the second printed circuit board 8. A center contact terminal element is realized by the contacting of this pin-shaped contact terminal element to stationary contact elements both on the first printed circuit board as well as on the second printed circuit board.

Although modifications and changes may be suggested by those skilled in the art, it is the intention of the inventors to embody within the patent warranted hereon all changes and modifications as reasonably and properly come within the scope of their contribution to the art.

We claim as our invention:

1. An electromagnetic relay comprising:

a magnet system having an excitation coil, a core and an armature;

coil terminal elements connected to said coil;

a base formed by an arrangement of printed circuit boards, said printed circuit board arrangement having a first printed circuit board facing toward said magnet system, and a second printed circuit board forming a bottom side of said base, and each of said first and second printed circuit boards having printed circuits;

at least one movable contact element actuated by said armature, said at least one movable contact element being arranged between said first and second printed circuit boards;

an actuation element transferring movement of said armature to said movable contact element and having a pin-shaped end section that projects through a recess in said first printed circuit board and is connected to said movable contact element;

stationary contact elements that are arranged at respective sections of said first and second printed circuit boards facing toward said movable contact element; and pin-shaped contact terminal elements projecting through congruent recesses in said first and second printed circuit boards and connected via said interconnects to said stationary contact elements, with contact between said contact terminal elements and respective interconnects occurs in a region of said recesses.

2. An electromagnetic relay according to claim 1, wherein said stationary contact elements are disposed on said first printed circuit board as well as on said second printed circuit board, forming change-over contacts.

3. An electromagnetic relay according to claim 1, wherein said first and second printed circuit boards are composed of a duro-plastic synthetic.

4. An electromagnetic relay according to claim 1, wherein said pin-shaped contact terminal elements are each positively surrounded by a respective annular spacer element in a section between said first and second printed circuit boards, wherein the outside diameter of said spacer element is larger than the diameter of said recesses through which said pin-shaped contact terminal elements are plugged.

5. An electromagnetic relay according to claim 4, wherein said spacer elements made of one piece are applied to said pin-shaped contact terminal elements.

6. An electromagnetic relay according to claim 1, wherein said pin-shaped contact terminal elements have their free ends fashioned to form press-in pins.

7. An electromagnetic relay according to claim 1, wherein said second printed circuit board is through-contacted; and wherein said contact terminal elements are formed by solder balls arranged at the underside of said second printed circuit board.

8. An electromagnetic relay according to claim 1, wherein said stationary contact elements are fashioned as solid contacts applied onto said interconnects.

9. An electromagnetic relay according to claim 1, wherein said stationary contact elements are fashioned as printed circuit board surfaces that are applied onto said interconnects and selectively coated with contact material.

10. An electromagnetic relay according to claim 1, wherein said stationary contact elements comprise contact rivets.

* * * * *